US009205957B2

(12) United States Patent
Koehn

(10) Patent No.: US 9,205,957 B2
(45) Date of Patent: Dec. 8, 2015

(54) SACK AND METHOD AND DEVICE FOR PRODUCING SACKS

(75) Inventor: Uwe Koehn, Osnabrueck (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 53 days.

(21) Appl. No.: 13/818,776

(22) PCT Filed: Aug. 15, 2011

(86) PCT No.: PCT/EP2011/064004

§ 371 (c)(1),
(2), (4) Date: Feb. 25, 2013

(87) PCT Pub. No.: WO2012/025413

PCT Pub. Date: Mar. 1, 2012

(65) Prior Publication Data

US 2013/0156352 A1 Jun. 20, 2013

Related U.S. Application Data

(60) Provisional application No. 61/344,581, filed on Aug. 25, 2010.

(30) Foreign Application Priority Data

Aug. 25, 2010 (DE) ..... 10 2010 039 770
Oct. 29, 2010 (EP) ..... 10189481

(51) Int. Cl.

| | |
|---|---|
| ***B65D 33/16*** | (2006.01) |
| ***B31B 29/00*** | (2006.01) |
| ***B65D 30/18*** | (2006.01) |

(Continued)

(52) U.S. Cl.

CPC ..... *B65D 33/1658* (2013.01); *B31B 21/00* (2013.01); *B31B 29/00* (2013.01); *B65D 31/08* (2013.01); *B65D 33/01* (2013.01); *B65D 33/1691* (2013.01); *B31B 2219/90* (2013.01); *B31B 2221/20* (2013.01); *B31B 2221/40* (2013.01); *B31B 2221/60* (2013.01)

(58) Field of Classification Search

CPC ..... B31B 1/74; B31B 19/14; B31B 19/90; B31B 21/00; B31B 37/00; B31B 2221/20; B31B 29/00; B31B 2237/20; B31B 2221/402; B65D 33/1658; B65D 31/08; B65D 33/01

See application file for complete search history.

(56) References Cited

U.S. PATENT DOCUMENTS 333,523 A * 1/1886 Honiss ..... 383/121
1,121,080 A 12/1914 Elliott (Continued)

FOREIGN PATENT DOCUMENTS

DE 1 761 327 7/1971
DE 42 42 178 6/1994

(Continued)

*Primary Examiner* — Sameh Tawfik
(74) *Attorney, Agent, or Firm* — Jacobson Holman, PLLC.

(57) ABSTRACT

A method for the production of sacks from tubular pieces which include plastic material includes at least at one end area, laying a bottom rectangle around a fold line to form triangular pockets, with the bottom rectangle including flaps, folding back parts of the flaps of the bottom rectangle, and applying and connecting a bottom cover sheet at least to areas of the flaps of the bottom rectangle and/or to areas of the triangular pockets. The bottom rectangle includes at least in part an air-permeable material.

10 Claims, 5 Drawing Sheets

(51) Int. Cl.
*B65D 33/01* (2006.01)
*B31B 21/00* (2006.01)

(56) References Cited

U.S. PATENT DOCUMENTS

| | | | | | |
|---|---|---|---|---|---|
| 1,867,399 | A | | 7/1932 | Elliott | |
| 3,853,040 | A | * | 12/1974 | Achelpohl | 493/194 |
| 3,924,521 | A | * | 12/1975 | Hanson et al. | 493/209 |
| 3,979,049 | A | * | 9/1976 | Achelpohl | 383/125 |
| 4,637,062 | A | * | 1/1987 | Poppe | 383/54 |
| 5,102,383 | A | * | 4/1992 | Achelpohl et al. | 493/226 |
| 8,597,167 | B2 | * | 12/2013 | Haeger et al. | 493/218 |

FOREIGN PATENT DOCUMENTS

| | | |
|---|---|---|
| DE | 20 2009 007 915 | 8/2009 |
| DE | 10 2008 017 442 | 10/2009 |
| EP | 0 767 105 | 4/1997 |
| WO | WO 2007/087965 | 8/2007 |
| WO | WO 2009/121842 | 10/2009 |

* cited by examiner

VI - VI

X - X

SACK AND METHOD AND DEVICE FOR PRODUCING SACKS

CROSS-REFERENCE TO RELATED APPLICATIONS

This is a national stage of PCT/EP11/064004 filed Aug. 15, 2011 and published in German, claiming benefit of U.S. provisional application No. 61/344,581, filed Aug. 25, 2010, which has a priority of German no. 10 2010 039 770.9 filed Aug. 25, 2010, and priority of Euruope no. 10189481.4 filed Oct. 29, 2010, hereby incorporated by reference.

BACKGROUND OF THE INVENTION

1. Field of Invention

The invention concerns a method for the production of sacks of tubular pieces which include plastic material, and a sack including plastic material. Furthermore, the invention concerns a device for the production of bottom cover sheet material, and a device for the production of sacks.

2. Description of the Prior Art

Sacks as well as production methods and devices have been known for a long time. In order to produce such sacks it is provided

- that at least at one end area of a tubular piece a bottom rectangle is laid around a fold line to form triangular pockets,
- that parts of the flaps of the bottom rectangle are folded back, and
- that a bottom cover sheet is applied at least to areas of the flaps of the bottom rectangle and/or to areas of the triangular pockets and connected to them.

The sacks provided with such bottoms are known as cross or block bottom sacks.

Many such sacks serve for the transport of bulk goods, such as perhaps building materials. Often used for this purpose are valve sacks which are manufactured separately and later filled via the valve. In order to achieve sufficient aeration of the as a rule powdery filling material in the sack, a sack wall is often perforated with fine needles. The hole diameters which can be achieved by needle punctures are however so large that along with air which is taken in, in particular during filling of the sack, an objectionable portion of the filling material also escapes from the holes and, for example, soils the sack on the outside.

Additional aeration concepts are therefore known in which the discharge of air is accomplished with a special form of aeration channel. For this the forming of special longitudinal seams is required. Such a sack is, for example, known from the Patent Application WO 2007/087965 A1 of the applicant. Such sacks have proven their value. However, in that process the tubular material from which the tubular pieces necessary for the production of the sacks are made individually must be produced from a web so that the introduction of the longitudinal seams is possible.

Particularly convenient but nonetheless high-strength sacks are often produced from a circular fabric which includes plastic threads. The circular fabric is as a rule coated on its outer side. Such sacks can be produced by hot air sealing without additional adhesive. In this case the coating of the fabric during the sealing process of the sack and cover sheet is melted on without damaging the fabric. In such a circular fabric the possibility of forming special longitudinal seams is not offered.

Furthermore, tubular sacks can be drawn upon as initial semi-finished products for the production of sacks which have been produced from a seamless tube produced in the blown-extrusion process. Also here no special longitudinal seams are formed. The production of such tubes is also economical.

SUMMARY OF THE INVENTION

It is thus the object of the invention to propose a sack as well as a method and a device for its production in which a sufficient aeration of the filling material is made possible.

The object is achieved by the various embodiments of the invention described herein.

Provided is the use of a bottom cover sheet which at least in part includes air-permeable material. In the above-described tubular sacks there is still only the possibility of providing sufficient aeration via the bottom areas. A bottom cover sheet serves as a rule to reinforce the bottom but according to the invention also assumes the function of aeration. Materials which are permeable to air but impermeable to the filling material are known. Within the scope of the present patent application are air-permeable materials which already have the property in themselves of letting air through. This property is inherent in the materials. Therefore no materials are intended which are made permeable to air by retroactive processing, e.g. by stitching or making holes. The air-permeable materials can be fleece or filter paper. Additional materials are known to those skilled in the art of producing sacks.

In order to improve the aeration it is advantageous if the path between the filling material and the bottom cover sheet comprising air-permeable material is not blocked to the greatest extent possible. Thus it is provided that the flaps are folded in such a manner that the edges of the flaps and the edges of the triangular pockets and/or the edge of the valve patch encircle an opening through which the interior of the sack is accessible. Unlike the otherwise customary mode of production in which the bottom flaps overlap it is provided accordingly that between the flaps an opening arises so that the air arrives unhindered at the air-permeable material and as a consequence reaches the outside. In order to achieve this effect at least approximately, overlapping bottom flaps can also, as previously, be provided which are provided with perforations, thus, for example, are pierced.

In a particularly preferred form of embodiment it is provided that the bottom cover sheet comprises at least two layers. It is provided that one of these layers includes air-permeable material. The particular advantage of this form of embodiment becomes clear if one observes that air-permeable material is as a rule mechanically less capable of bearing a load than the actual sack material. Thus the additional layer of the bottom cover sheet, said layer not necessarily consisting of an air-permeable material, can assume the function of reinforcing the bottom while the aeration function remains in the air-permeable material. A suitable, strong material can be provided for this purpose. An example would be a network of threads and fibers which can absorb tensile forces very well without tearing.

In connection with this it is of particular advantage if the first layer facing the flaps or the triangular pockets consists of air-impermeable material and in which perforations which enable the passage of air have been introduced. The perforations can perhaps be punch-outs. The perforations are advantageously circular since then the strength is impacted as little as possible. This development of the invention makes it possible to provide for the first layer that same material from which the tubular pieces are produced. In order to enable aeration by the second layer, openings or air passages must be provided in the first layer. In so doing, the size of the openings must be chosen so that the strength of the material is only affected to a permissible extent. The likeness of the materials is in particular advantageous because the bottom cover sheet layer can be connected by the same process or the same adhesives very well to the additional sack components as these are also used in customary cover sheet fastening. In this case the connection points are also very strong.

The second layer then includes air-permeable material and is expediently applied to the first layer and connected to it. The connection is advantageously accomplished by gluing, thermal sealing, or ultrasonic welding along a connecting seam. Even if the application is possible after attaching the first layer to the bottom, it is preferable to carry out the application before attaching the bottom cover sheet to the sack. Since bottom cover sheets as a rule are provided as web material, it is even advantageous to glue the first layer and the second layer together in a web state. Only in the production of sacks can the web material forming the bottom cover sheets be separated individually to form the actual bottom cover sheets.

In an advantageous development of the invention the gluing of the air-permeable material is done so that all the perforations of the first layer are encircled by the connecting seam. It is particularly advantageous if each individual perforation is encircled by a connecting seam, e.g. an adhesive track. In so doing, the connecting seam in question can be a spacing from the encircled perforation so that the surface which is enclosed by the connecting seams is greater than the surface of the perforations of the first layer. Thus a greater aeration surface is achieved and the air-permeable material is well utilized. In so doing, the air which during the filling process is pressed through the perforations at comparable pressure can be distributed over this surface. Subsequently it can escape via the air-permeable material. In connection with this, the distribution over the surface helps to reduce the pressure and to prevent bursting of the adhesive seam. High aeration pressures can also occur during the dropping of the sacks, e.g. directly after filling.

Preferably each surface encircled by the adhesive seams is at least twice as large as the surface of the corresponding perforation. In this case a good aeration effect is also expected even at high rates of filling.

In a particular advantageous development of the invention a third layer of the bottom cover layer is applied to the second layer. This layer is or will be connected to the first and/or second layer. This can in turn be done after the application of the bottom cover sheet to the sack, but preferably before. The third layer can in particular be connected or become connected to the long side edges of the first layer of the as a rule rectangular bottom cover sheet. In that process the third layer can be connected to two adhesive or sealing seams. The first and the third layer can also be formed as one piece. After the gluing on the second layer the first layer's piece overshooting the second layer can then be folded around. The edges of the first and thereby arising third layer can be connected to one another by a seam. Pieces overshooting on both sides can also be provided. These are folded, where the edges overlap. The edges are connected to one another, for which gluing processes or heat-induced joining processes can be utilized. On the face sides of the bottom cover sheet the third layer preferably remains unconnected to the first two layers so that through these openings the air which arrives through the air-permeable material can be freed. For a good aeration the seams on the large longitudinal sides can be interrupted and/or the face sides partially fastened. Also, mechanically produced openings in the third layer, perhaps needle punctures, can be provided.

The described third layer can protect the air-permeable material against external influences and thus against damage. In addition this layer offers the possibility of being printed on. Finally, any penetration of moisture into the interior of the sack can be avoided so that the filling material does not change its properties essentially.

In a preferred development it is provided that cuts are provided in the third layer. These cuts are located preferably in the vicinity of the perforations of the first layer. These cuts can serve as a valve. The air which penetrates the air-permeable material then does not have to escape exclusively through the openings on the face sides of the bottom cover sheet but rather can in addition reach the outside through the cuts. The aeration power of the sack can be increased significantly in this way. If the perforation of the first layer is circular, then it is recommended to introduce at least one cut in the form of a circular arc. In so doing, the radius of the circular arc should be somewhat larger than the radius of the perforations so that the air-permeable material of the second layer also continues to be protected against external influences. The midpoints of a perforation of the first layer and of the cut in the form of a circular arc should coincide.

In a particularly preferable development of the invention tubular pieces are used which are formed from a seamlessly produced tube. In particular the seamlessly produced tube comprises a circular fabric of extended plastic bands which is coated with a plastic. In this case the first and the optional third layer of the bottom cover layer comprise a fabric of plastic bands where this fabric is also provided with a coating. In this case the sack and the bottom cover sheet can be connected to one another by a heat-induced joining process. Therein the coatings are melted on and the individual parts are pressed on one another. The coatings are melted and form after cooling a connecting layer between the layers. Damage of the fabric is avoided in this joining process. The first layer of the bottom cover sheet guarantees sufficient strength of the sack in the area of the bottom cover sheet. Since it consists of fabric it can absorb strong forces. The joined connection is also suitable for this purpose. The perforations for the passage of air are small and do not weaken the cover sheet significantly. The second layer of air-permeable material holds the filling material back but enables the throughput of air. An optimally suitable material can be selected to fulfill this function. This can, for example, be a highly porous paper. It also resists the heat of the heat-induced joining process. Thus this material is superior to a plastic fleece.

It is expedient before fastening the bottom cover sheet on the bottom area of the sack to the areas of the bottom cover sheet's side facing the bottom of the sack, said areas covering the opening, to apply a separation agent. This measure prevents the connecting of the cover sheet to the interior side of the sack if this is not completely covered by the flaps of the bottom rectangle, thus if an opening is present. The measure is above all advantageous in the application of a heat-induced joining process.

The subject of the present invention is a sack which includes plastic material. This sack has in addition the following features:

- a tubular body,
- a bottom folded at least at one end of the tubular body, said bottom comprising triangular pockets and these triangular pockets at least partially overlapping flaps, and
- a bottom cover sheet with which the bottom is covered where the bottom cover sheet is applied at least to areas of the flaps and/or areas of the triangular pockets and connected to them.

The sack according to the invention is distinguished in that the bottom cover sheet includes at least in part air-permeable material.

Additional advantageous developments of the method follow from the description provided herein. The advantages of these developments have already been given in the present application by the description of production methods.

An additional subject of the present application, said subject being based on the same inventive concept, is a device for the production of bottom cover sheet material which can be used in a method and/or for a sack as described herein.

In known sack production methods and devices the bottom cover sheet material has already been provided in the form of a web. From this bottom cover sheet web a bottom cover sheet is separated individually and applied to the already folded sack bottom. The device according to the invention provides a web of bottom cover sheet material with which a sack can be produced, in which sufficient aeration of the filling material is made possible.

For this the device comprises first a take-off device with which a first web comprising plastic can be taken off. Into this web perforations are introduced. For this a perforation-producing device, e.g. a punch, is provided.

With a second take-off device a second web which includes air-permeable material can be taken off of a roll. A consolidation unit follows with which the first and second web can be consolidated. The first web is at this moment already provided with perforations. For connecting the first and the second web the consolidation unit can comprise corresponding device with which gluing, thermal sealing, or ultrasonic welding is possible.

In a particularly preferred form of embodiment an adhesive unit is provided with which the first web can be provided with adhesive coatings. This adhesive unit is expediently positioned before the consolidation unit so that on consolidation of the webs the first web is provided with adhesive coatings.

In an additional development of the invention a web folding device follows with which parts of the first web can be folded so that the second web is covered. In connection with this the web-folding device can perhaps comprise guide plates.

To cover the second web an additional take-off device can be provided with which a covering web can be taken off from a roll. This web could consist of a particularly economical material.

In an additional development of the invention a printing device can be provided with which a separating agent can be applied to the first web. The first web would then not need to be printed in a separate printing machine.

In an advantageous form of embodiment of the invention a take-up device is provided with which the bottom cover sheet web produced in the previously described manner can be taken up. The roll with such a bottom cover sheet web can then be applied to a customary device for the production of sacks so that, without this device and the corresponding sack production method having to be changed, the method according to the invention can be carried out and sacks according to the invention can be produced.

The subject of the present invention is however also a device for the production of sacks from tubular pieces into which the described device for the production of bottom cover sheet material can be integrated. A take-up device is in this case not provided since the bottom cover sheet material web produced with the described mechanisms, devices, and units can be separated individually and directly to form bottom cover sheets which can then be conveyed to the bottom cover sheet station.

A preferred device for the production of sacks of tubular pieces is described in WO 2009/121842 A1. The content of this specification is considered hereby as incorporated into this application in order not to have to repeat the individual device components and method steps. To this device a device can be allocated for the production of bottom cover sheet material and then forms a device according to the invention for the production of sacks of tubular pieces.

Additional embodiment examples of the invention follow from the description of the subject of the invention and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
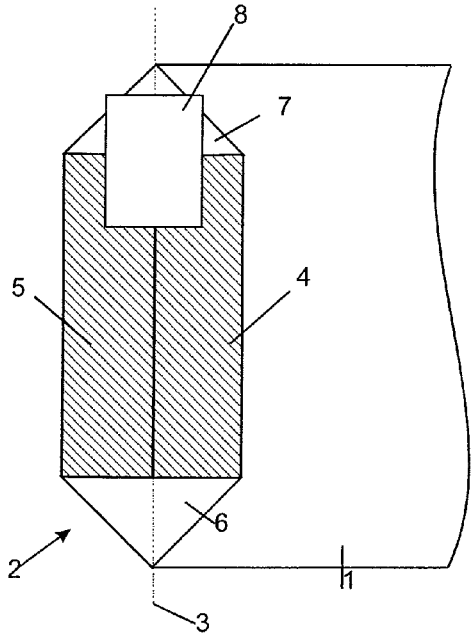
FIG. 1 a partial view of a sack with a drawn-up bottom

FIG. 1 shows a partial view of a tubular piece or of a sack 1 which, for example, consists of a flattened circular fabric of extended plastic bands which after the flattening process was provided with a plastic coating. The end area of the tubular piece 1 has already been drawn up to form a bottom rectangle 2. For this the two walls of the tubular piece lying one over the other which arise in the flattening process are folded up around a fold line 3 which at the same time represents the midline of the later bottom so that the resulting flaps 4, 5 subsequently lie in a plane. The flaps 4 and 5 then form the bottom rectangle. Through this folding there arise in the side areas the triangular pockets 6 and 7. To one of the triangular pockets, in the illustrated case to the triangular pocket 7, a valve patch, from which a valve will later arise, or a valve 8 is applied. Via this valve 8 the sack can later be filled.

In order to prepare the bottom, parts of the flaps 4 and 5 are folded back around the folding edges 9 and 10. Areas of the flaps 4 and 5, specifically those areas overlapping with the lateral triangles 6 and 7 or those areas overlapping with the valve 8, can be fixedly connected to them. A fixed connection can however be made by the later application of the bottom cover sheet so that the overlapping areas just described do not have to be connected specifically to one another.

In customary sacks the edge areas of the flaps 4 and 5 overlap so that even without a bottom cover sheet a closed bottom can form. In a sack according to the invention and its method of production the edge areas assume a spacing from one another so that an opening 11 remains via which there is a connection of the interior of the sack with the outside through which the air introduced with the filling of the sack can escape. This opening 11 is bounded by the edges of the flaps 4 and 5 as well as the edges of the triangular pocket 6 and of the valve 8.

Figure 2:
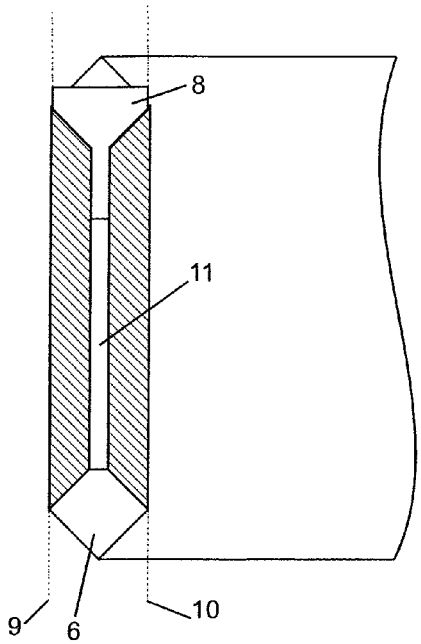
FIG. 2 a partial view of a sack with folded-over flaps of the bottom rectangle FIG. 3 a base sheet for the production of a bottom cover sheet according to the invention FIG. 4 like FIG. 3 but with air-permeable material glued on FIG. 5 like FIG. 4 but with lateral sections rotated FIG. 6 the view VI-VI from FIG. 5 seen from the interior of the sack FIG. 7 perspective view of a sack according to the invention FIG. 8 view of a cover sheet with cuts in the form of circular arcs FIG. 9 view of a cover sheet with rectangular cuts FIG. 10 side view of a sack with escaping air FIG. 11 view of a device for the production of a bottom cover sheet web FIG. 12 perspective view of the device from FIG. 11

With the aid of FIGS. 3 to 6 an embodiment example of the invention will be explained. In these figures the production of a bottom cover sheet is shown which, connected to a sack according to FIG. 2, generates a sack according to the invention.

Figure 3:
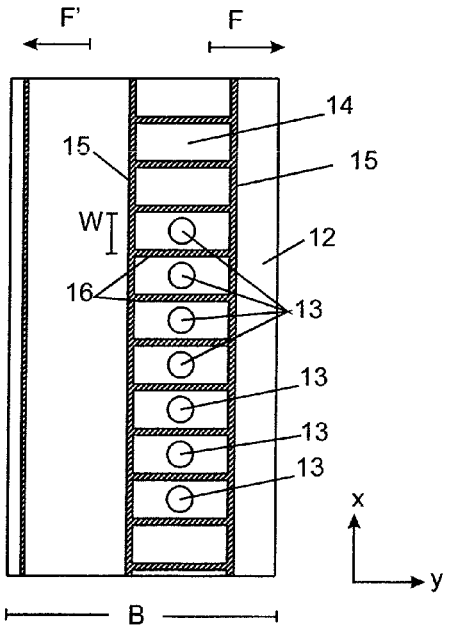

FIG. 3 shows the base sheet 12 which has a width B which is at least twice as large as the desired width BD of the later bottom cover sheet (see FIG. 7). The material of the base sheet 12 is preferably the material of the sack 1, i.e. a fabric of plastic bands. Unlike the tubular piece the base sheet consists preferably of one layer and can be coated on one side. In this case the material is impermeable to air. Furthermore, in FIG. 3 perforations 13 can be seen which are preferably circular and which preferably can be applied by means of at least one punching device. The perforations can thus also be called punch-outs. However, the perforations can also be produced with other devices such as, perhaps, a laser cutting device. In so doing, the perforations 13 are disposed on the base sheet 12 so that they later lie over the opening 11 of the bottom. Only then can the air which arrives through the opening 11 also pass through the perforations 13.

In particular during the filling process the base sheet 12 is acted on by the forces which are symbolized by the arrows F and F'. The form and the size of the perforations are chosen so that the durability of the base sheet is merely restricted to an acceptable degree. Here it seems to be advantageous to space each of the perforations from the others in the x-direction by at least its opening width W. In the areas of the valve 8 and the triangular pocket 6, areas 14 which are as free of perforations as possible must be provided.

In FIG. 3 the base sheet 12 is already provided with adhesive tracks. These adhesive tracks comprise adhesive tracks 15 running longitudinally and adhesive tracks 16 running transversally. Each two adhesive tracks 16 and sections of the two adhesive tracks 15 encircle a perforation 13. Such an arrangement of the adhesive tracks provided for a secure fastening of an air-permeable patch or a web and prevents air and/or filling material from escaping laterally under the filter paper. In connection with this the surface enclosed by the adhesive tracks is preferably twice as large as the surface of the perforations 13. The areas 14 which are free of perforations can also be encircled by adhesive tracks. Of course, at least no adhesive tracks running transversely are necessary here but rather the tracks can be applied in a simple way by means of an applicator roll which then, for simplicity's sake, also remains positioned at the perforation-free areas on the base sheet 12. This applies in particular if several base sheets 12 are transported successively, e.g. as a web.

Figure 4:
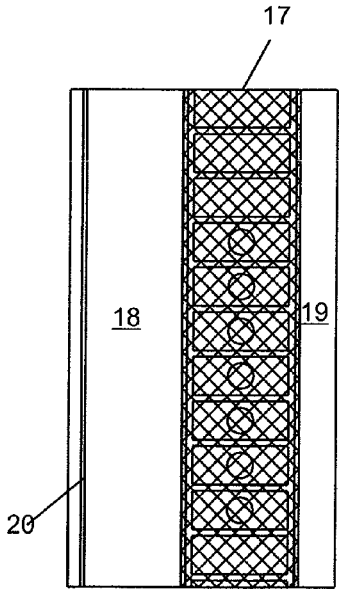

FIG. 4 shows the base sheet 12 from FIG. 3 but with a glued-on patch 17 of air-permeable material which forms the second layer of the later bottom cover sheet. The patch 17 can also be provided successively, perhaps in the form of a web. In FIG. 4 this patch is represented with hatching. The perforations 13 and the adhesive tracks 15, 16 not visible in themselves are nonetheless drawn in. The patch 17 consists, for example, of a coarsely porous filter paper which allows air to pass very well but holds back the filling material. The filter paper by itself cannot take up the forces F and F'. However, the expandability offers a great advantage. During surges in pressure, as can occur during the filling or dropping of a sack, air arrives through the opening 11 and the perforations 13 in the spaces bounded by the adhesive tracks and lying between the base sheet 12 and the patch 17. The patch material then yields a little so that the volume of said spaces becomes greater. In this way the air reservoir is provided so that the air can gradually escape through the patch 17.

In FIG. 4 the lateral sections 18 and 19 of the base sheet 12 are represented, where in the vicinity of one of the two outer edges, in the example shown in the vicinity of section 18, an additional adhesive track 20 running longitudinally has been applied.

Figure 5:
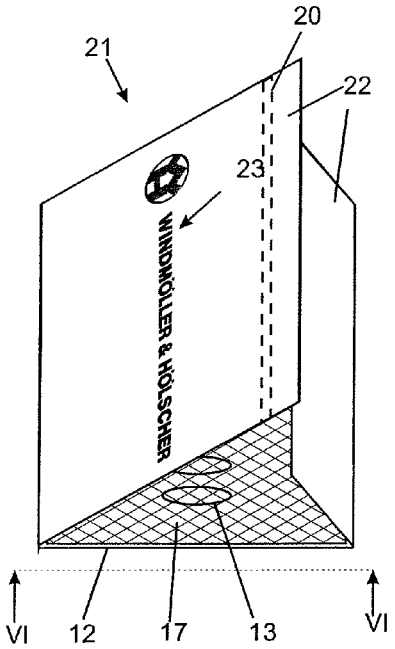

The two lateral sections 18 and 19 are then rotated around edges running in the x-direction so that their edges overlap and the adhesive track 20 lies between them. This is represented in FIG. 5. The then no longer visible adhesive track 20 is represented here with broken lines. If the base sheets 12 are used in this instance in a web, the rotation is similar to the formation of a tube, as is known, for example, in the fabrication of paper tubes for the production of paper bags.

After the folding of the lateral sections at least the complete outer surface of the bottom cover sheet 21 thus arising can be coated if a base sheet coated on at least one side was used. The lateral areas which then form a third layer 22 have different functions. For one thing they protect the patch 17 against damage and humidity. In addition they can be used as carriers of information. For this purpose, print can be applied to the base sheets 12 even before their processing. Already mentioned repeatedly by way of example, the coatings of fabric of plastic bands are a well suited substrate for printing. An example of a print motif 23 is shown.

Figure 6:
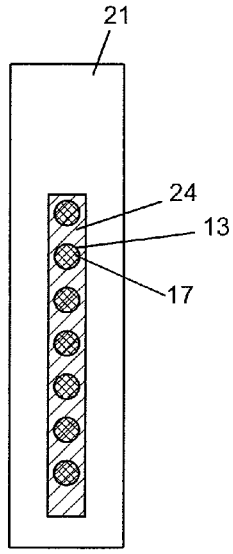

FIG. 6 shows a rear side view of the cover sheet 21 which is produced. Through the perforations 13 the patch 17 can be seen. A hatched area can be seen which represents a surface 24 provided with a separating agent. A separating agent is advantageous in particular when the bottom cover sheet 21 is applied by means of a heat-induced joining process to the bottom of the sack. The bottom cover sheet then does not connect to the inner surfaces of the sack. Suitable as a separating agent in this case is a separating lacquer which before the processing of the base sheet 12 can be applied to it with a known printing process and by means of a printing device. The surface 24 provided with the separating agent is preferably congruent to the opening 11 of the already folded bottoms. The surface 24 can however also be negligibly larger than the opening 11 in order to compensate manufacturing imprecision.

The patch 17 is expediently also treated with a separating agent or consists of a material which does not connect with the inner surfaces of the sack during the gluing or joining process. This applies, for example, for paper during a heat-sealing process.

Figure 7:
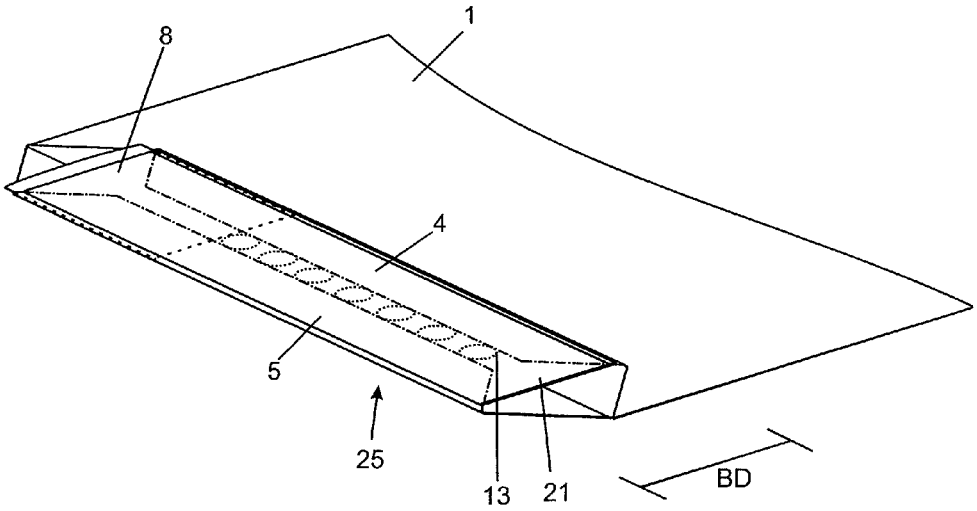

FIG. 7 shows a section of a finished sack 1, which includes the finished sack bottom 25, in which the bottom cover sheet 21 has been applied, in particular sealed on. The position of the perforations 13 is represented as dots, the position of the flaps 4 and 5 as a dot-and-dash line. This view illustrates that the perforations 13 lie in the area of the opening 11, which is bounded essentially by the flaps 4 and 5. Shown by a broken line is the position of the valve 8 whose edge also represents a boundary of the opening 11. The print motif 23 is not represented in this figure.

Figure 8:
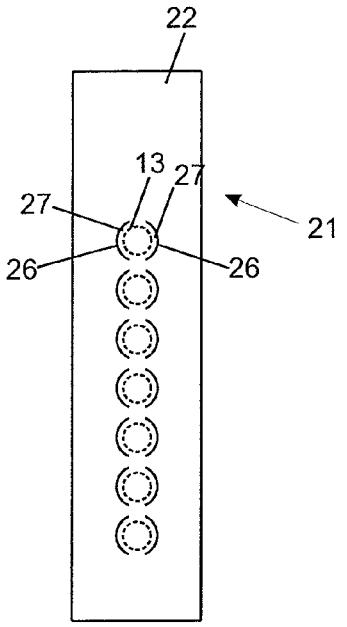

FIG. 8 shows the top view of an additional bottom cover sheet 21 which can be used for an additional form of embodiment of the invention. The third position 22 of the bottom cover sheet 21 is visible. Represented by a broken line are the perforations 13 of the first layer, which in the embodiment example of FIG. 8 are round. Cuts 26 in the form of circular arcs are provided concentrically to this circumferential line of the perforations 13. By these cuts 26 flaps 27 are produced which can be raised with respect to the third layer so that the patch 17 can come into direct contact with the environment. This air coming through the patch 17 can thus be emitted directly to the environment in a simple way. It is shown that the cuts 26 have a spacing from the circumferential lines of the perforations. Each cut can cover a certain angular range which, for example, can be 135°. From this it follows that the angular range in which the flaps are fastened to the third layer is twice 45°. If the flaps are raised there is therefore an aeration channel 28, which points outwards, i.e. the air escapes outwards (see arrow 29 in FIG. 10) and thus away from the bottom midline. In the course of the aeration channel the aeration cross section thus becomes continuously larger, which significantly improves the aeration.

Figure 9:
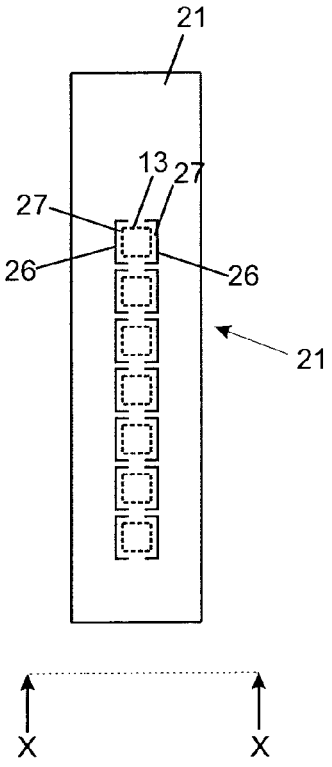

FIG. 9 shows an additional embodiment variant of the invention. Here the perforations 13 are represented as rectangles. Also the cuts 26 are made to be rectangular. Shown once again is an example in which the cuts 26 encircle the perforations 13 with some spacing.

Figure 10:
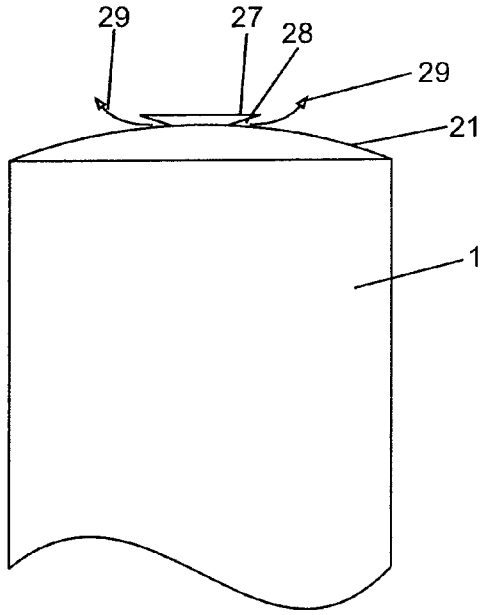

FIG. 10 shows the side view of a sack 1 at that moment in which the air taken in exits. In this case the bottom cover sheet 21 as a rule bulges outwards. Under this influence and under the influence of the outwardly flowing air the flaps 27 are pressed outwards so that the aeration channels 28 open. The air can then escape, roughly in the direction of the arrow 29.

Figure 11:
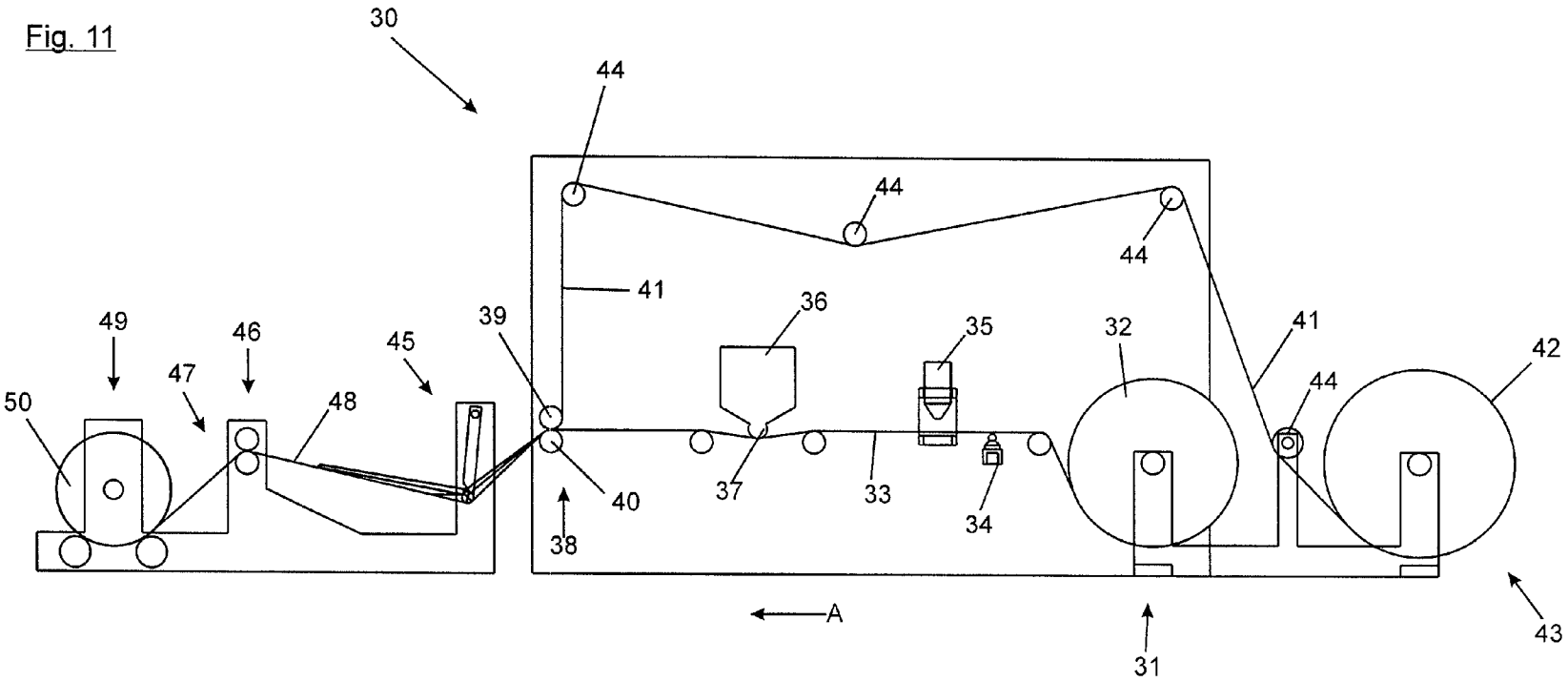
Figure 12:
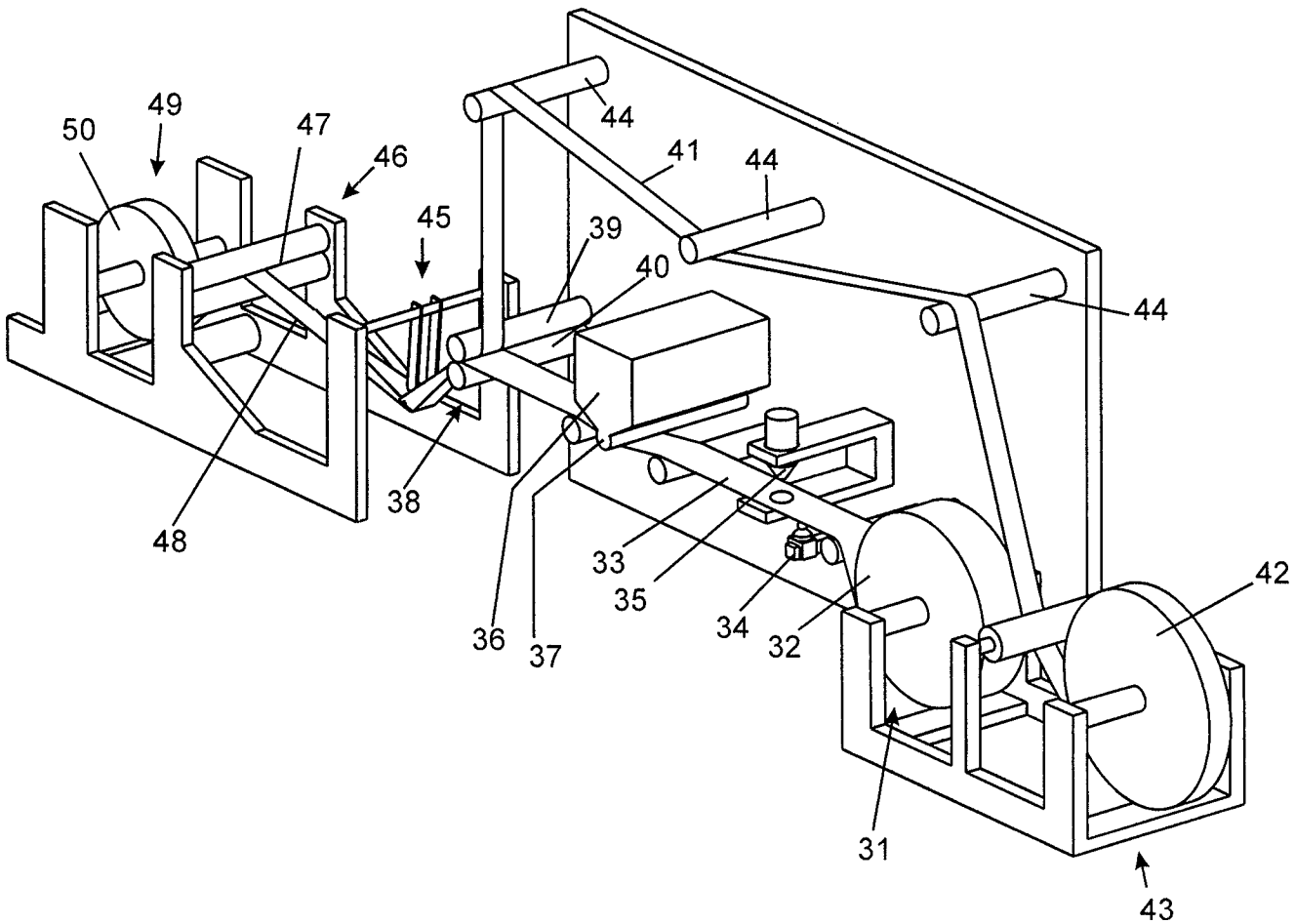

FIGS. 11 and 12 show a device 30 for the production of bottom cover sheets 21 as have been shown in FIGS. 3 to 6. The device comprises first of all a take-off station 31 in which a roll 32 is rotatably mounted. On the roll 32 a base material web 33 is wound which represents the basis for the later bottom cover sheets 21. The base material web 33 is already provided at the desired points with a separating agent and/or with one or more print motifs. In particular for the imprinting of print motifs a separate printing machine is recommended since the often desired multicolor printing requires a mechanism which would unnecessarily enlarge and thus increase the cost of the device 30. In addition the printing of the web can be done in part significantly more rapidly in separate printing machines. By contrast, it is readily possible in the device 30 to provide a printing mechanism with which the separating agent can be applied. Since in the present embodiment example of FIGS. 3 to 6 the separating agent and print motif are printed on the same side of the web it is expedient to apply the separating agent at the same time as the print motif in a printing machine. Thus in FIG. 8 a printing mechanism for applying the separating agent is not shown.

After being taken off, the web 33 first passes a sensor 34 such as perhaps an optical scanner with which the position of the print motif or the coatings of separating agent can be detected. For this purpose the web 33 can however also be provided with registration marks. Via the sensor 34 the adhesive unit 36 and the punching device 35 described below can be controlled so that punches and coatings of adhesive can be executed with precise registration.

The optical scanner 34 is followed in the direction of transport A by a punching device 35 with which the perforations 13 can be introduced into the web 33. Also, the cuts 26 can be produced with it or with a similar punching device. The punching device 35 can be revolving, that is, the punching knife or knives can be disposed on a roller so that the web can be transported at a uniform speed. The punching device 35 can however also comprise punching knives which can be raised or lowered. Since the web must be at a standstill in this case, at least one web storage device not represented can be provided so that despite the standstill the web can be continuously taken off of the roll and/or continuously provided with a coating of adhesive. Furthermore, the punching device 35 comprises a suction device also not represented with which any punching waste can be suctioned off.

The punching device is followed by an adhesive unit 36 with which the adhesive tracks 15 and 16 can be applied. The adhesive track 20 can also be applied with the adhesive unit 36. However, for this adhesive track an additional adhesive unit can be provided which is disposed immediately before the tube-forming station. The adhesive used can be of the hot melt type. However, other types of adhesives which enable cold gluing can be expedient. The adhesive can be applied with a plate roller 37. In connection with this the plate roller comprises areas varying in height (elevations and indentations) and adhesive-bearing areas whose contour corresponds to the desired adhesive coating. However, a nozzle assembly can also be provided in which the flow of adhesive can be switched on and off with valves. The desired adhesive tracks can also be applied in this way. Plate rollers and nozzle systems per se are known to those skilled in the art and are thus not described further at this point.

In the consolidation station 38 comprising a roller 39 and an opposing roller 40 a web 41 including air-permeable material is applied to the web 33 provided with adhesive. The web 41 is provided in the form of a roll 42. In the take-off station 43 the web 41 is taken off of the roll 42 and conveyed via several deflecting rollers 44 to the consolidation station 38.

The web composite arising in station 38 is then conveyed to a tube-forming station 45 in which the lateral sections 18 and 19 of the later bottom cover sheets are rotated and their edge areas are glued to one another.

The thus produced tube 48, which can also be called a cover sheet web, first passes the draw unit 46. It comprises a pair of rollers 47 through whose roller gap the tube runs and which provides the tube with the drive force needed for transport and transport of the still unconsolidated webs 33 and 41.

Thereafter the tube 48 can be taken up in a take-up device 49 to form a roll 50.

The thus completed roll with cover sheet material in the form of a web can then be brought to a sack production machine. Customary sack production machines as shown in FIG. 1 of WO 2009/121842 already mentioned comprise as a rule take-off devices which are equipped with cover sheet material taken up on rolls. Within the sack production machine the web is separated into individual cover sheets and fastened on the bottoms of sacks. This procedure has proven its value for years. In order to produce sacks according to the invention the sack production machine does not need to be changed. The cover sheet material produced in a described device 30 can be processed in a known manner in a sack production machine. In order to be able to spare take-up of the finished cover sheet web, the device 30, reduced by the take-up machine 49, can be put at the point of the take-off devices of the sack production machines.

FIG. 12 shows in conclusion a perspective view of the device 30 according to FIG. 11. Even if it is a schematic representation it can be seen that the web 33 has a greater width than the web 41.

The present application discloses a plurality of features and forms of embodiments in reference to products, devices, and methods according to the invention. Even if different features and forms of embodiment are merely disclosed in connection with certain other features and forms of embodiment, all features and forms of embodiment are to be considered as freely combinable with one another without this combination of features having to be mentioned explicitly.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference numbers

| | |
|---|---|
| 1 | Tubular piece/sack |
| 2 | Bottom rectangle |
| 3 | Fold line |
| 4 | Flap |
| 5 | Flap |
| 6 | Triangular pocket |
| 7 | Triangular pocket |
| 8 | Valve |
| 9 | Fold line |
| 10 | Fold line |
| 11 | Opening |
| 12 | Base sheet |
| 13 | Perforations |
| 14 | Perforation-free areas |
| 15 | Longitudinally running adhesive track |
| 16 | Transversely running adhesive track |
| 17 | Patch |
| 18 | Lateral section of the base sheet 12 |
| 19 | Lateral section of the base sheet 12 |
| 20 | Longitudinally running adhesive track |
| 21 | Bottom cover sheet |
| 22 | Third layer |
| 23 | Print motif |
| 24 | Surface, provided with separating agent |
| 25 | Sack bottom |
| 26 | Cut |
| 27 | Flap |
| 28 | Aeration channel |
| 29 | Direction of escape of air |
| 30 | Device for the production of bottom cover sheets |
| 31 | Winding station |
| 32 | Roll |
| 33 | Base material web |
| 34 | Sensor/optical scanner |
| 35 | Punching device |
| 36 | Adhesive unit |
| 37 | Plate roller |
| 38 | Consolidation unit |
| 39 | Roller |
| 40 | Opposing roller |
| 41 | Web containing air-permeable material |
| 42 | Roll |
| 43 | Take-off station |
| 44 | Deflecting roller |
| 45 | Tube-forming station |
| 46 | Draw unit |
| 47 | Pair of rollers |
| 48 | Tube |
| 49 | Take-up device |
| 50 | Roll |
| A | Direction of transport of the web |
| B | Width of the base sheet 12 |
| BD | Width of the bottom cover sheet 21 |
| x | Direction along the longitudinal axis of the base sheet 12 |
| y | Direction transverse to the longitudinal axis of the base sheet 12 |

What is claimed is:

1. A method for the production of sacks from tubular pieces which include plastic material comprising:

laying at least at one end area a bottom rectangle around a fold line to form triangular pockets, with said bottom rectangle including flaps, folding back parts of the flaps of the bottom rectangle, and applying and connecting a bottom cover sheet at least to areas of the flaps of the bottom rectangle and/or to areas of the triangular pockets, the bottom cover sheet including a first layer and a second layer, with the first layer facing the flaps and/or triangular pockets having a material of construction that is an air-impermeable material, the first layer having perforations introduced therein, and adhesive connecting seams thereon that completely encircle individually each of the perforations, and the second layer having a material of construction that includes an air-permeable material, and the second layer being applied to the first layer and connected thereto via the adhesive connecting seams.

2. The method according to claim 1, wherein the flaps are folded such that edges of the flaps and edges of the triangular pockets and/or an edge of a valve patch encircle an opening through which an interior of the sack is accessible.

3. The method according to claim 1, wherein each surface encircled by the adhesive connecting seams is at least twice as large as a surface of the corresponding perforation.

4. The method according to claim 1, further comprising a third layer that is applied to and is connected to at least one of the first layer and the second layer.

5. The method according to claim 4, wherein into the third layer, at least in a vicinity of the perforations of the first layer, cuts are introduced.

6. The method according to claim 5, wherein the cuts are made in a form of a circular arc.

7. The method according to claim 6, wherein a seamlessly produced tube is used which includes a circular fabric of extended plastic bands, with the circular fabric being coated with a plastic.

8. The method according to claim 1, wherein the bottom cover sheet is fastened to a bottom area of the sack by a heat-induced joining process.

9. The method according to claim 8, wherein before the fastening of the bottom cover sheet to the bottom area of the sack, a separating agent is applied to areas of a side of the bottom cover sheet, including the side facing the bottom of the sack, which covers an opening through which an interior of the sack is accessible.

10. The method according to claim 1, wherein the adhesive connecting seams that encircle each of the perforations individually include a pair of opposed seams extending longitudinally along the bottom sheet, and a pair of opposed seams extending transversely across the bottom sheet.

* * * * *